US009061522B2

(12) United States Patent
Obenshain

(10) Patent No.: US 9,061,522 B2
(45) Date of Patent: Jun. 23, 2015

(54) REVERSIBLE PRINTER ASSEMBLY

(75) Inventor: Marc R. Obenshain, Cumming, GA (US)

(73) Assignee: Panduit Corp., Tinley Park, IL (US)

( * ) Notice: Subject to any disclaimer, the term of this patent is extended or adjusted under 35 U.S.C. 154(b) by 2333 days.

(21) Appl. No.: 11/908,647

(22) PCT Filed: Mar. 16, 2006

(86) PCT No.: PCT/US2006/009563

§ 371 (c)(1), (2), (4) Date: Apr. 22, 2008

(87) PCT Pub. No.: WO2006/102000

PCT Pub. Date: Sep. 28, 2006

(65) Prior Publication Data

US 2009/0226234 A1 Sep. 10, 2009

Related U.S. Application Data

(60) Provisional application No. 60/662,526, filed on Mar. 16, 2005.

(51) Int. Cl.

| | |
|---|---|
| ***B41J 11/00*** | (2006.01) |
| ***B41J 3/407*** | (2006.01) |
| ***B41J 11/66*** | (2006.01) |

(52) U.S. Cl.

CPC ..... *B41J 3/4075* (2013.01); *B41J 11/663* (2013.01)

(58) Field of Classification Search

USPC ..... 400/613, 194, 36, 218, 222, 207, 223

See application file for complete search history.

(56) References Cited

U.S. PATENT DOCUMENTS

| | | | |
|---|---|---|---|
| 4,591,879 | A | 5/1986 | Yokota et al. |
| 4,650,351 | A | 3/1987 | Engle et al. |
| 4,685,817 | A | 8/1987 | Surti |

(Continued)

FOREIGN PATENT DOCUMENTS

| | | |
|---|---|---|
| JP | 07-246738 | 9/1995 |
| JP | 2002-338130 | 11/2002 |

*Primary Examiner* — Matthew G Marini

(74) *Attorney, Agent, or Firm* — Christopher S. Clancy; James H. Williams

(57) ABSTRACT

A method and apparatus for printing labels with reduced waste. The method includes printing a label on an end-portion of a label roll and advancing the label roll such that the end-portion passes a cutter mechanism. The cutter mechanism cuts the end-portion, thereby defining a new end-portion. The method further includes reversing the label roll to align the new end-portion with a printer head. The apparatus may be a drive mechanism that includes a roller for feeding label material in a forward feed mode and in a reverse feed mode. The drive mechanism has a drive clutch configured to engage with a take-up printer ribbon spool. The drive clutch may be operated to (i) transfer a driving force to the take-up printer ribbon spool in a forward feed mode and (ii) allow a release of printer ribbon in a reverse feed mode. The drive mechanism further includes a reverse clutch having a return spring. The reverse clutch may engage with a payout printer ribbon spool and may be operated to (i) prime the return spring of the in the forward feed mode and (ii) transfer a driving force from the return spring to the payout printer ribbon spool in the reverse feed mode. The drive mechanism may be incorporated into a hand-held printer, and therein interact with a removable label cassette to reduce waste of the label material and/or ink ribbon.

10 Claims, 5 Drawing Sheets

(56) References Cited

U.S. PATENT DOCUMENTS

| | | | | |
|---|---|---|---|---|
| 4,702,631 | A | 10/1987 | Watanabe | |
| 4,725,157 | A | 2/1988 | Nakai et al. | |
| 4,741,640 | A | 5/1988 | Yoshioka | |
| 4,753,545 | A | 6/1988 | Kohlhage et al. | |
| 4,775,260 | A * | 10/1988 | Kecmer | 403/409.1 |
| 4,806,033 | A | 2/1989 | Ukmar et al. | |
| 4,815,875 | A | 3/1989 | Richardson et al. | |
| 4,838,718 | A | 6/1989 | Okumura et al. | |
| 4,934,847 | A | 6/1990 | Shiozaki et al. | |
| 4,952,086 | A | 8/1990 | Yamaguchi | |
| 5,069,563 | A | 12/1991 | Daggs | |
| 5,078,523 | A | 1/1992 | McGourty et al. | |
| 5,143,461 | A | 9/1992 | Inoue et al. | |
| 5,160,205 | A | 11/1992 | Mistyurik | |
| 5,160,943 | A | 11/1992 | Pettigrew et al. | |
| 5,181,788 | A | 1/1993 | Norman, Jr. et al. | |
| 5,184,152 | A | 2/1993 | French | |
| 5,224,784 | A | 7/1993 | Haftmann et al. | |
| 5,277,504 | A | 1/1994 | Takeda | |
| 5,284,396 | A | 2/1994 | Masumura et al. | |
| 5,294,203 | A | 3/1994 | Williams | |
| 5,295,753 | A | 3/1994 | Godo et al. | |
| 5,297,879 | A | 3/1994 | Oikawa | |
| 5,320,437 | A | 6/1994 | Malke et al. | |
| 5,415,482 | A | 5/1995 | Poole et al. | |
| 5,431,504 | A | 7/1995 | Beadman et al. | |
| 5,454,650 | A | 10/1995 | Yamaguchi | |
| 5,469,774 | A | 11/1995 | Kaspers | |
| 5,507,583 | A | 4/1996 | Beaty et al. | |
| 5,533,818 | A | 7/1996 | Bahrabadi | |
| 5,542,487 | A | 8/1996 | Schultz et al. | |
| 5,549,401 | A | 8/1996 | Ishikawa et al. | |
| 5,593,237 | A | 1/1997 | Nozaki et al. | |
| 5,605,403 | A | 2/1997 | Vegeais et al. | |
| 5,607,244 | A | 3/1997 | Satoh et al. | |
| 5,622,440 | A | 4/1997 | Yamamoto et al. | |
| 5,711,623 | A | 1/1998 | Nose | |
| 5,718,525 | A | 2/1998 | Bruhnke et al. | |
| 5,741,082 | A | 4/1998 | Toya | |
| 5,788,384 | A | 8/1998 | Goodwin et al. | |
| 5,820,277 | A | 10/1998 | Schulte | |
| 5,820,279 | A | 10/1998 | Lodwig et al. | |
| 5,820,280 | A | 10/1998 | Fox | |
| 5,859,656 | A | 1/1999 | Aragon et al. | |
| 5,906,444 | A | 5/1999 | Jorgensen | |
| 5,938,350 | A | 8/1999 | Colonel | |
| 5,951,177 | A | 9/1999 | Schanke et al. | |
| 6,006,661 | A | 12/1999 | Tukahara et al. | |
| 6,067,103 | A | 5/2000 | Ewert et al. | |
| 6,082,914 | A | 7/2000 | Barrus et al. | |
| 6,089,768 | A | 7/2000 | Barrus et al. | |
| 6,129,463 | A | 10/2000 | Lau et al. | |
| RE36,953 | E | 11/2000 | Lodwig et al. | |
| 6,142,686 | A | 11/2000 | Schanke et al. | |
| 6,267,521 | B1 | 7/2001 | Lodwig et al. | |
| 6,307,583 | B1 | 10/2001 | Randolph et al. | |
| 6,315,471 | B1 | 11/2001 | Hsich et al. | |
| 6,334,724 | B2 * | 1/2002 | Yamaguchi et al. | 400/615.2 |
| 6,361,228 | B1 | 3/2002 | Barrus et al. | |
| 6,428,225 | B1 | 8/2002 | Nguyen et al. | |
| 6,629,791 | B2 | 10/2003 | Penzo | |
| 6,637,957 | B2 | 10/2003 | Mastinick et al. | |
| 6,644,876 | B2 | 11/2003 | Carriere et al. | |
| 6,709,179 | B2 | 3/2004 | Yamaguchi et al. | |
| 6,753,894 | B2 | 6/2004 | Yoshida | |
| 7,040,822 | B2 | 5/2006 | Fries et al. | |
| 2003/0081978 | A1 | 5/2003 | Carriere et al. | |

* cited by examiner

REVERSIBLE PRINTER ASSEMBLY

FIELD

The present invention relates generally to labeling and, more particularly, to an apparatus and method of reducing printing waste.

BACKGROUND

Printing machines, or printers, are used to produce labels bearing legends, graphics, and text, such as instructions or warnings, etc. A variety of printers may be used for this application, ranging for example from large industrial printers, to commonplace desktop printers, such as laser, thermal transfer, inkjet or dot matrix printers, to portable or hand-held printers, such as a hand-held thermal transfer label printer.

Printers may print information on a variety of media, e.g., label rolls, label sheets, photographic paper, etc. For many labeling applications, labels are printed on continuous label media or a series of individual labels carried on a continuous liner or carrier. For instance, the label media may be a roll of pressure sensitive tape that is attached to a liner by an adhesive. The printer may then print a series of legends along the tape, and the individual labels are formed by cutting through the tape and liner between each pair of legends to separate each individual label from the roll. The liner would then typically be removed so that the label can be applied to its desired location.

A common problem with low cost hand-held thermal transfer printers is label and liner waste. These printers can only feed the labels and ribbon in one direction (forward) through the printing mechanism. Additionally, the label must be cut after a print job. Generally, there is a large gap between the print-line and the cut position. Thus, a large unprinted area is fed past the print-line before cutting the printed label. Two problems result: (i) increased costs of label supplies; and (ii) fewer labels per label roll.

SUMMARY

Disclosed is a hand-held thermal transfer printer with a cassette reversing mechanism suitable for either continuous or pre-cut labels and thermal transfer ribbon. The label material may include, for instance, continuous heat shrink tubing, vinyl self-laminating labels, polyester self-laminating labels, vinyl and polyester continuous tapes, non-adhesive labels, vinyl cloth labels, and others.

According to one embodiment, the printer and cassette use a unique mechanism for reducing label waste. The embodiment operates by feeding labels in both a forward and a reverse direction. By reversing the label, the printer can optimize label usage and eliminate the requirement for a large un-printed area before and/or after the printed label. In operation, the printer prints a label and moves the label roll in a forward direction to allow the printed label to exit the printer through a slot before being cut by a cutter. Once the label is Cut, the printer moves the label roll in a reverse direction. The label roll comes to rest in a position optimally aligned for printing the next label without wasting label material or ribbon length.

In the embodiment, a cassette reversing mechanism is included in the printer that is capable of reversing the label and ribbon for a short distance, enough to account for the distance between the print-line and cut position. A goal of the preferred embodiment is to reverse the label and ribbon without causing ribbon wrinkling during operation. This is generally achieved by maintaining tension on the ribbon.

The cassette reversing mechanism comprises an assembly including a bearingless directional clutch, a reversing clutch, and a nip roller. These three components work together to prevent ribbon wrinkling during operation.

In the forward feed direction, the nip roller pulls ribbon from a supply roll—causing the shaft of the reversing clutch to twist and prime a return spring of the reversing clutch. When the return spring is primed, a post attached to the printer contacts a stop, such as a limit plate stop. At that point, a drag spring of the reversing clutch allows the reversing clutch to slip. As the reversing clutch rotates forward, the return spring maintains tension on the advancing ribbon. Meanwhile, during operation in the forward feed direction, a two-sided ratchet mechanism inside the bearingless directional clutch remains in a locked position and operates by transferring power to a take-up ribbon spool, preventing slack and wrinkling.

When the mechanism switches to a reverse feed direction, the payout ribbon spool attached to the reversing clutch is allowed to rewind. In order to prevent wrinkling during the rewind process, the return spring in the reversing clutch continues to provide tension on the ribbon until the mechanism advances again. As the payout ribbon spool maintains tension on the ribbon, the drive clutch begins to slip without losing tension or allowing the ribbon to overrun the nip roller or to wrinkle.

DETAILED DESCRIPTION OF THE DRAWINGS

Figure 1:
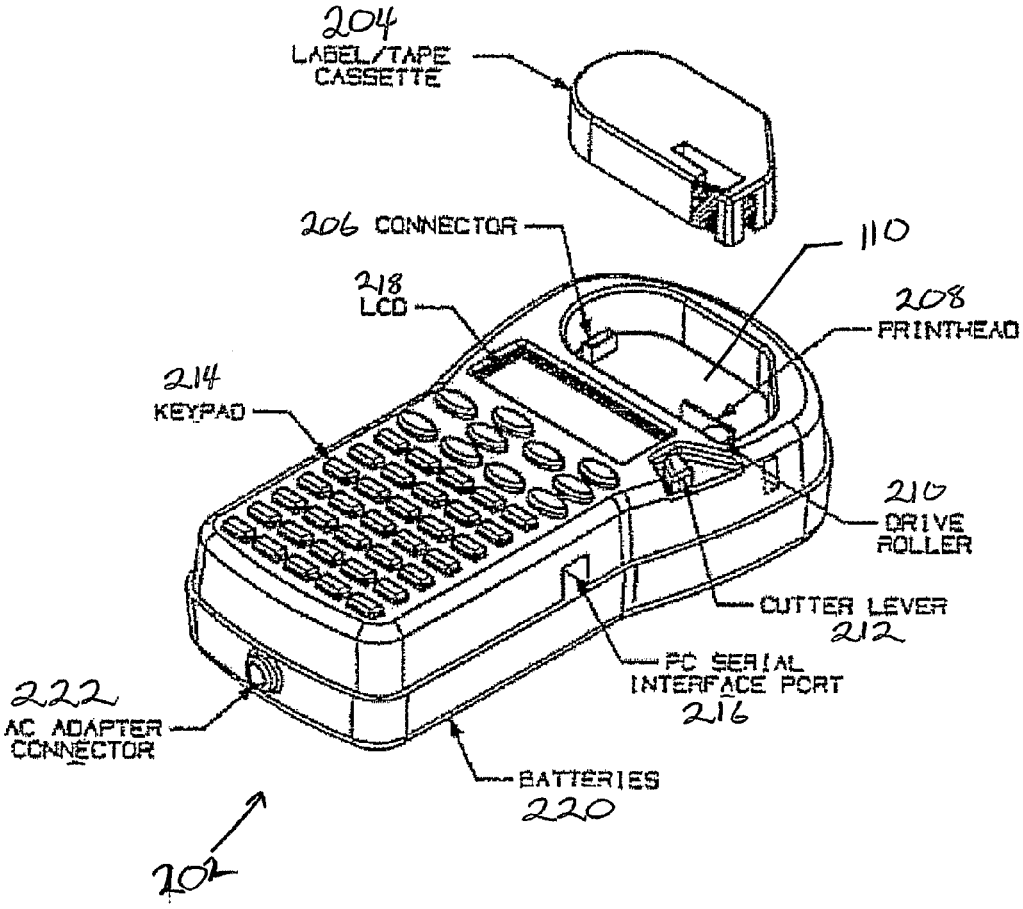
FIG. 1 is a perspective view of a hand-held thermal transfer printer and a printer cassette.

FIG. 1 provides a perspective view of a hand-held thermal transfer printer 202 and a printer cassette 204 in accordance with an exemplary embodiment of the invention. A cassette bay 110 is a recessed area of the printer 202 and is configured to receive the printer cassette 204.

The printer cassette 204 contains both label material and thermal transfer ribbon. During operation, as the label material and ribbon are used, an exhausted printer cassette 204 may be replaced with a fresh cassette.

The cassette bay 110 may further include a data connector 206 for obtaining electronic data from the printer cassette 204, a printhead 208 for supplying heat to transfer ink from the ribbon to the label material for imprinting labels, a nip roller 210 (A.K.A. Drive roller) for feeding label material out of the cassette 204 and past a cutter blade for cutoff. The nip roller 210 may be made of an elastomeric material such as a silicon rubber. Alternatively, the nip roller 210 may be made of metal in order to prevent compression of the roller which could adversely affect label feed control and cut length. The nip roller 210 may also be textured to provide additional grip for driving the label media from the cassette 204. However, depending upon the material used to construct the nip roller 210, a smooth surface on the roller may promote better grip.

Although not-shown, a drive clutch and a reversing clutch may be located within the cassette bay 110 and engage respectively with a take-up ribbon spool and a payout ribbon spool of the printer cassette 204.

A manual cutter lever 212 is configured to allow a user to cut the printed label material after it has exited the printer cassette 204. Once the printed label material is cut, a reversing mechanism of the printer 202 may rewind the label material in order to conserve label material. The reversible feed drive is also useful for providing accurate label positioning. The reversible drive allows labels to be positioned precisely to allow exact cut length.

User input and output is available through an LCD screen 218, a keypad 214, PC Serial Interface Port 216, or other mechanisms known to those skilled in the art. Power may be supplied to the printer 202 through batteries 220 and/or an AC adaptor connector 222, for instance.

Figure 2:
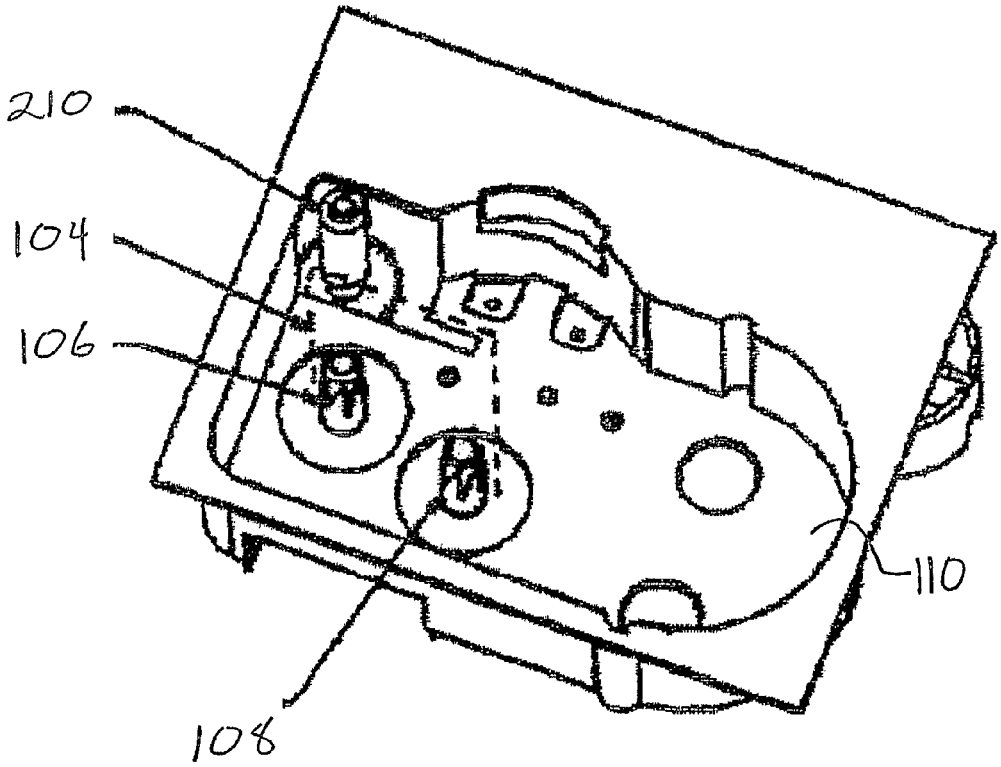
FIG. 2 is a perspective view of a cassette reversing mechanism.

FIG. 2 provides a perspective view of the cassette reversing mechanism of the hand-held thermal transfer printer in accordance with a preferred embodiment. The cassette bay 110 is shown including three elements that operate to feed label material and ribbon to a printhead of the thermal transfer printer. The nip roller 210 preferably has a rubber surface, but may be a metal roller. The drive clutch 106 is configured to engage with the take-up ribbon spool of the cassette. The drive clutch 106 includes a directional clutch that transfers power to the take-up ribbon spool when rotated in a forward-feed direction, but allows the take-up ribbon spool to rotate or slip in a reverse-feed direction. As the take-up ribbon spool rotates in the reverse-feed direction, the directional clutch maintains tension in the ribbon in order to prevent slack and wrinkling of the ribbon or label material. The reversing clutch 108 is configured to engage with the payout ribbon spool of the cassette. While maintaining tension on the ribbon, the reversing clutch 108 allows the payout ribbon spool to unwind in the forward-feed direction. However, in the reverse-feed direction, the reversing clutch 108 creates a tension in the ribbon that partially rewinds the ribbon. As shown by the dashed line, the ribbon path 104 extends from the reversing clutch 108 past the nip roller 210 to the drive clutch 106.

Figure 3:
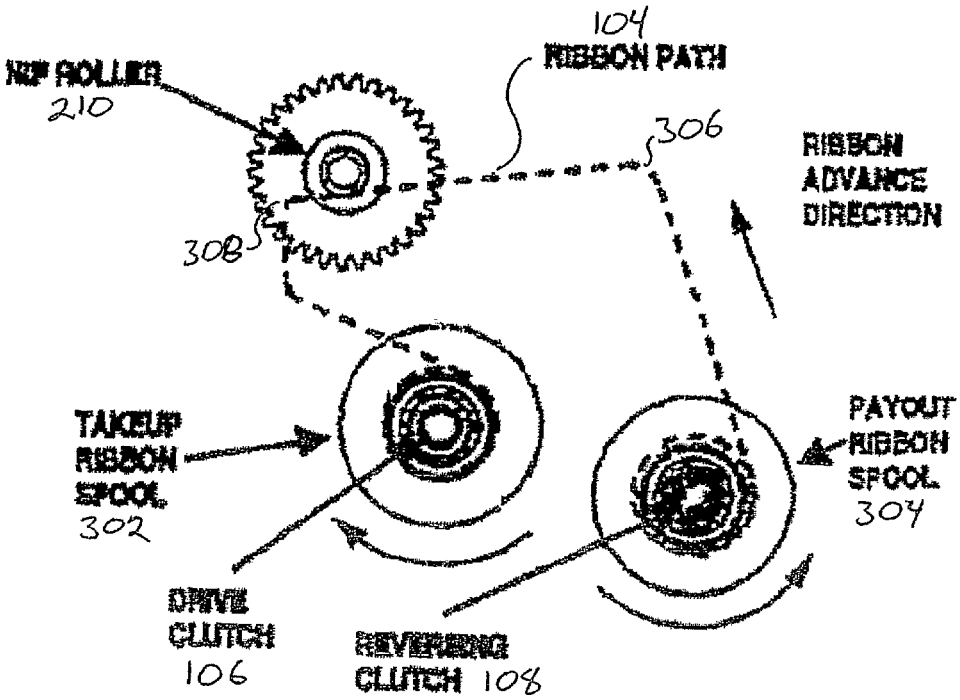
FIG. 3 is a plane view showing components of a cassette reversing mechanism.

FIG. 3 provides a plane view of components of the cassette reversing mechanism, showing the clutch elements of the printer engaged with the spool and ribbon elements of the cassette. The ribbon path 104 is shown passing from the payout ribbon spool 304 to the nip roller 210 and then to the take-up ribbon spool 302. Although not shown, other elements such as a molded pins or metal pins may further direct the ribbon path 104. For example, a first bend 306 in the ribbon path 104 is preferably created as the ribbon passes a plastic post or rib located within the cassette or extending from the surface of the cassette bay.

The drive clutch 106 is shown engaged in the take-up ribbon spool 302. Likewise, the reversing clutch 108 is shown engaged in the payout ribbon spool 304. According to the preferred embodiment, when a printer cassette is inserted into the cassette bay, the two clutches 106, 108 are inserted into holes in the cassette and engaged with an inner aperture of the spools 302, 304.

In a new printer cassette, ribbon will be wound primarily around the payout ribbon spool 304, with only a minimal amount attached to the take-up ribbon spool 302. During operation, the ribbon advances in a forward feed direction (Ribbon advance direction) and is wound about the take-up ribbon spool 302. During forward-feed, the nip roller 210 and take-up ribbon spool 302 rotate in a clockwise direction (from above), while the payout ribbon spool 304 rotates in a counterclockwise direction. During reverse-feed, the various directions of rotation are the opposite to those during forward-feed.

In an embodiment, a second bend 308 in the ribbon path 104 provides a separation point for the ribbon and label materials. In the forward direction, as the ribbon moves past the second bend 308, the label material continues to go straight. Eventually, as the spools continue to advance, the printed label material exits the printer and may be cut. In order to reduce wasted label material and ribbon, once the printed label material is cut, the ribbon may be reversed. Unprinted label material that had passed the printhead may be rewound and set in a position for printing. Fine-tuned reverse control is done through the nip roller 210. As such, the nip roller 210 is preferably configured to apply a controlled pressure to the ribbon and label material in order to feed in both directions without compression of the roller or slippage.

Figure 4:
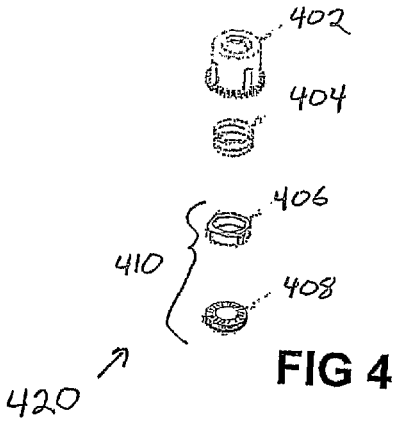
FIG. 4 is an exploded view of a directional clutch.

FIG. 4 provides an exploded view of the bearingless directional clutch 420 of the drive clutch. The bearingless directional clutch is configured about an axis and includes a gear driven housing (that is generally referred to as a cup or clutch cup) 402, a two-piece ratcheting mechanism 410 that includes side A 406 side B 408, and a compression ratchet spring 404.

The two sides 406, 408 of the ratcheting mechanism 410 each include a complementary set of angled teeth. Thus the teeth of side A 406 are aligned to fit against the teeth of side B 408. For example, the teeth may be in a saw-tooth pattern. The ratchet spring 404 and ratcheting mechanism 410 fit within the clutch cup 402. During operation, the ratchet spring 404 presses against the ratcheting mechanism 410 to hold the two pieces of the mechanism together.

Figure 5:
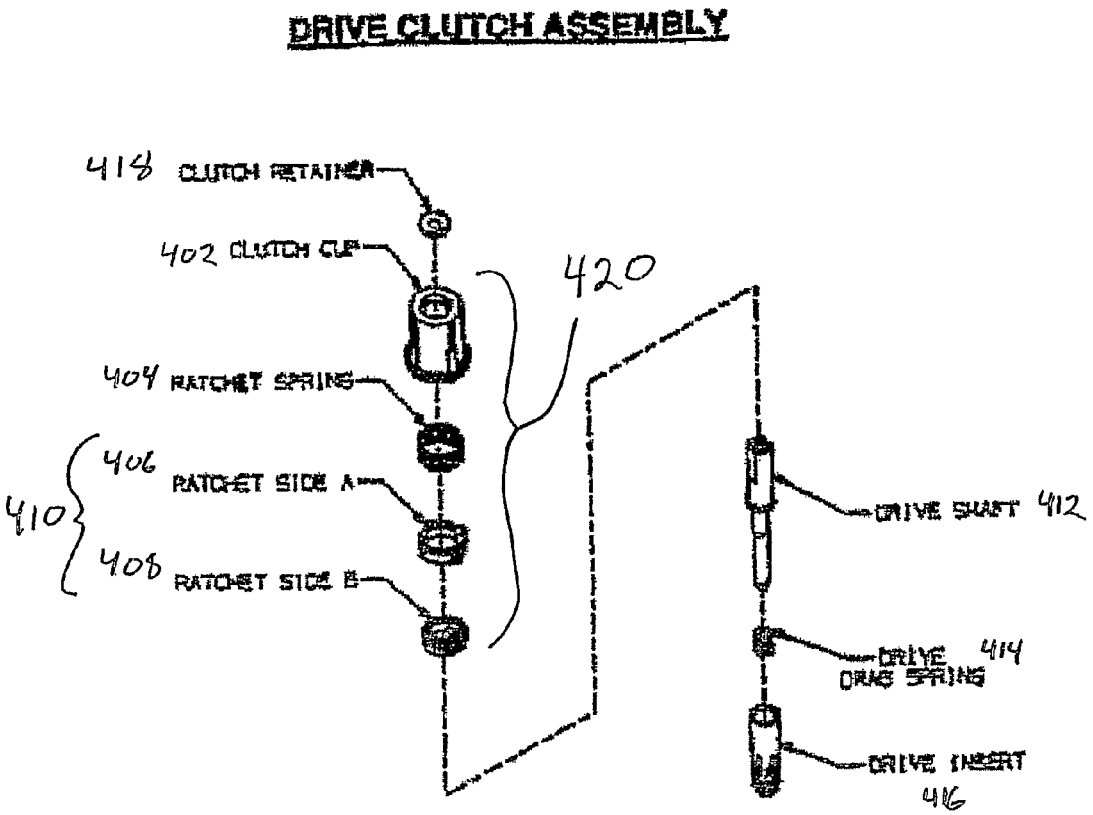
FIG. 5 is an exploded view of a drive clutch assembly.

FIG. 5 provides an exploded view of the drive clutch assembly including the bearingless directional clutch 420. A drive insert 416 connects with a gear of the printer and provides rotational torque to the drive clutch assembly. A drive drag spring 414 may be provided with the connection between a drive shaft 412 and the drive insert 416. In an embodiment, the drag spring 414 gives the drive insert 416 gear a propensity to engage when rotating in the forward direction and the motion and the impetus to disengage when in the reverse direction. The drag spring 414 allows for slip between the drive shaft 412 and drive insert 416, thereby maintaining tension on the ribbon.

The bearingless directional clutch 420, including the clutch cup 402, ratchet spring 404, and ratcheting mechanism 410 (406 and 408), is configured to fit over an upper portion of the drive shaft 412. A clutch retainer 418 may hold the bearingless directional clutch 420 to the drive shaft 412. The drive clutch assembly is configured to engage with the take-up ribbon spool of a printer cassette. More particularly, the clutch cup 402 is configured with an engaging mechanism for transferring torque between the clutch cup 402 and the take-up ribbon spool.

In a further embodiment, an o-ring is added to a groove in the drive shaft 412 and sits under the ratcheting mechanism 410. When the directional clutch 420 is installed in a printer housing, the o-ring is compressed between the drive shaft 412 and a bearing surface of the printer housing, thus creating a frictional resistance. In the embodiment, this resistance is greater than the resistance created by the ratchet spring 404 that presses together on ratchet sides A and B 406 and 408. When the printer is running in the reverse feed direction, the resistance from the o-ring allows the ratchet sides A and B 406 and 408 to slip.

Figure 6:
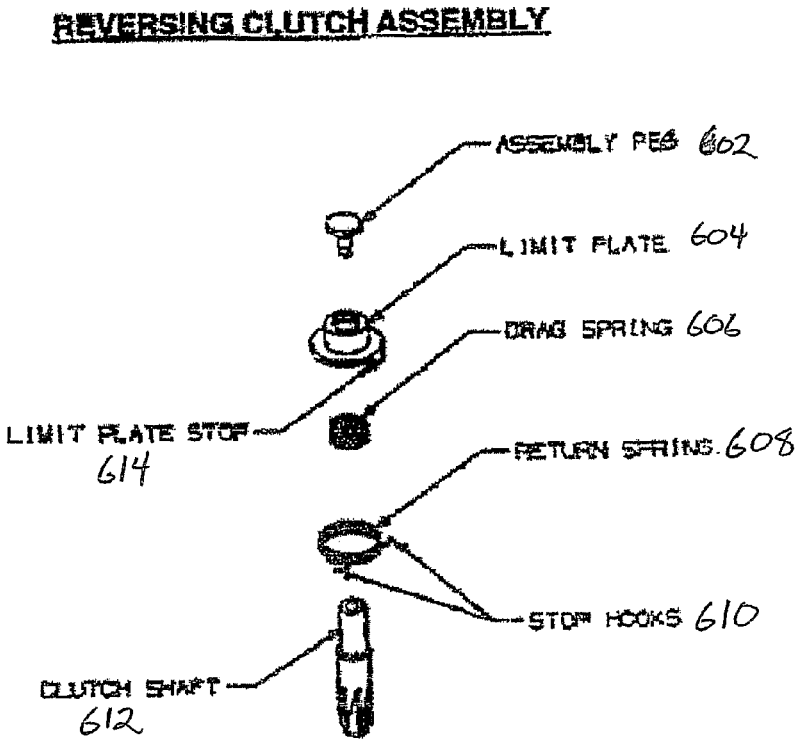
FIG. 6 is an exploded view of a reversing clutch assembly.

FIG. 6 provides an exploded view of the reversing clutch assembly. A reversing clutch shaft 612 connects with a gear of the printer and provides rotational torque to the reversing clutch assembly. A return spring 608 sits on the reversing clutch shaft 612 and provides a torque for reverse-feed of the ribbon. A reverse drag spring 606 fits between the reverse clutch shaft 612 and a limit plate 604 and allows for slip between the reverse clutch shaft 612 and the limit plate 604. Two stop hooks 610 on the return spring 608 allow the return spring 608 to be set while turning in a forward-feed direction. The limit plate 604 includes a limit plate stop 614 that is engaged with a stop hook 610 and serves as a back-stop to the spring. An assembly peg 602 holds together the reversing clutch assembly.

In the forward feed direction, the nip roller pulls the labels and the ribbon from a supply roll on the payout ribbon spool, causing the reversing clutch shaft to wind the return spring until a limit plate contacts a stop on the printing mechanism housing. At that point, a drag spring within the drive clutch begins to slip, allowing the ribbon to continue to advance while maintaining tension on the ribbon. Meanwhile, two ratchet sides inside the drive clutch (side A and side B) remain locked and thus, transfer power to a take-up ribbon spool.

Figure 7:
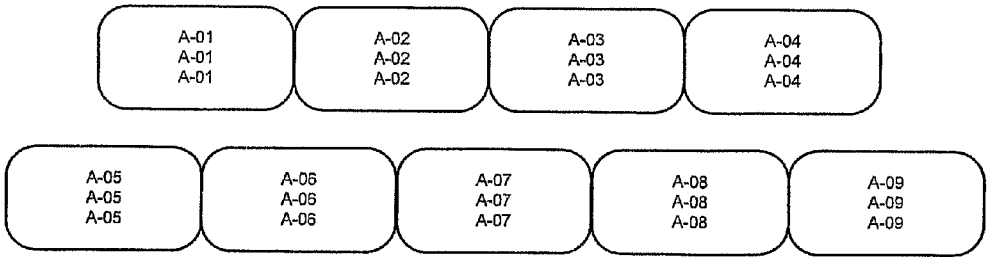
FIG. 7 is a view of printed labels.

FIG. 7 shows the resulting labels, which may be printed, saved, edited, etc., using a general purpose printing application executed by the printer. As shown, each individual label may abut another label. The presently described embodiments allow an individual label to be printed, ejected from the printer, and cut. In order to eject the printed label from the printer, at least a portion of the subsequent label must pass beyond the printhead of the printer. In order to avoid wasting the label, once the label is cut (or after some other trigger), the label material is reverse-fed so that it can be printed.

In a preferred embodiment, the printer is configured to automatically select appropriate label formats (e.g., label size and material), create the legends to be printed on the labels, format the legends on the labels in a manner that is appropriate for the labeling task, and export the legends and associated formatting and label information to a label file in a general purpose printing application.

The labeling application tool may be utilized to generate a wide variety of label types, including but not limited to self-laminating or wraparound labels, continuous strips of self-adhesive material, die-cut self-adhesive labels, self-adhesive signs with text and graphics, self-adhesive labels with text and graphics, die-cut self-adhesive laminated labels and non-adhesive labels. Perhaps more importantly, the labeling application tool may automatically select all the appropriate label types for the user's labeling task. The selection of the appropriate label type may be automatically made based on information about the item(s) being labeled, information from specifications or standards, or other sources.

The labeling application tool described herein provides a number of advantages for users undertaking the labeling task. The modular structure, if utilized, not only allows the user to install only those modules that are to be used, but also associates labeling tasks with specific markets, so that it is unnecessary for the user to have highly specialized knowledge about the item(s) to be labeled, governing standards and/or specifications, label types and formats, etc. In addition, the variety of described process options provides a flexible and user-friendly approach to the labeling task. The user interfaces, lists and interviews are relatively intuitive in comparison with existing labeling software, so that less training of the user in the use of the labeling application tool is required and the user may spend less time creating labels. In addition, by automating label definition and the generation of a list of label legends, label selection and data entry errors are reduced, providing savings in time and material expense.

Many modifications and other embodiments of the invention will come to mind to one skilled in the art to which this invention pertains having the benefit of the teachings presented in the foregoing descriptions and the associated drawings. For instance, although described as a hand-held thermal printer, the printer may alternatively take other forms, such as a stationary printer, ink-jet, or other printer. Therefore, it is to be understood that the invention is not to be limited to the specific embodiments disclosed and that modifications and other embodiments are intended to be included within the spirit and scope of the present invention. Although specific terms are employed herein, they are used in a generic and descriptive sense only and not for purposes of limitation.

What is claimed is:

1. A hand-held label printing apparatus comprising:

a printer cassette comprising:

a take-up printer ribbon spool;

a payout printer ribbon spool;

a printer ribbon extending between the two spools; and a roll of label material;

a hand-held thermal transfer printer, wherein the hand-held thermal transfer printer comprises:

a cassette bay for coupling to the printer cassette;

a printhead for supplying heat to transfer ink from the printer ribbon to the label material;

a roller for feeding label material out of the cassette and past a cutter mechanism;

a drive clutch configured to engage with the take-up printer ribbon spool of the printer cassette, wherein the drive clutch is operable to (i) transfer a driving force to the take-up printer ribbon spool in a forward feed mode and (ii) allow a step-wise release of printer ribbon in a reverse feed mode, wherein the drive clutch includes a two-piece ratcheting mechanism and a compression ratchet spring, the two-piece ratcheting mechanism including a first ratchet piece having a first set of angled ratchet teeth and a second ratchet piece having a second set of angled ratchet teeth complimentary to the first set of angled ratchet teeth, the compression ratchet spring pressing together the first ratchet piece and the second ratchet piece to engage the first set of angled ratchet teeth and the second set of angled ratchet teeth; and a reverse clutch configured to engage with the payout printer ribbon spool of the printer cassette, wherein the reverse clutch is operable to (i) prime a return spring in the forward feed mode and (ii) transfer a driving force from the return spring to the payout printer ribbon spool in the reverse feed mode.

2. The apparatus of claim 1, wherein the printer further comprises:

a screen providing a user output; and a keypad providing a user input.

3. The apparatus of claim 1, wherein the printer is configured to operate in reverse feed mode to rewind label material after an individual label is cut by the cutter mechanism, thereby conserving label material.

4. The apparatus of claim 1, wherein the roller is a nip roller, and wherein the nip roller is configured to apply controlled pressure in a given direction to feed label material without substantial compression of the roller and without substantial slippage of the label material.

5. The apparatus of claim 1, wherein the reverse clutch is configured with a stop plate configured to limit rotation of the return spring once the return spring is primed.

6. The apparatus of claim 1, wherein the reverse clutch includes a two-piece ratcheting mechanism and a compression ratchet spring to press together the two-pieces of the ratcheting mechanism.

7. A drive mechanism comprising:

a roller for feeding label material in a forward feed mode and in a reverse feed mode;

a drive clutch configured to engage with a take-up printer ribbon spool, wherein the drive clutch is operable to (i) transfer a driving force to the take-up printer ribbon spool in the forward feed mode and (ii) allow a release of printer ribbon in the reverse feed mode, wherein the drive clutch includes a two-piece ratcheting mechanism and a compression ratchet spring, the two-piece ratcheting mechanism including a first ratchet piece having a first set of angled ratchet teeth and a second ratchet piece having a second set of angled ratchet teeth complimentary to the first set of angled ratchet teeth, the compression ratchet spring pressing together the first ratchet piece and the second ratchet piece to engage the first set of angled ratchet teeth and the second set of angled ratchet teeth; and a reverse clutch including a return spring, wherein the reverse clutch is configured to engage with a payout printer ribbon spool, and wherein the reverse clutch is operable to (i) prime the return spring of the in the forward feed mode and (ii) transfer a driving force from the return spring to the payout printer ribbon spool in the reverse feed mode.

8. The drive mechanism of claim 7, wherein the reverse clutch is configured with a stop plate configured to limit rotation of the return spring once the return spring is primed.

9. The drive mechanism of claim 7, wherein the reverse clutch includes a two-piece ratcheting mechanism and a compression ratchet spring to press together the two-pieces of the ratcheting mechanism.

10. The drive mechanism of claim 7, wherein the drive clutch comprises a bearingless directional clutch.

* * * * *